US007637961B2

(12) United States Patent
El A'mma et al.

(10) Patent No.: US 7,637,961 B2
(45) Date of Patent: Dec. 29, 2009

(54) COMPOSITION AND METHOD FOR PREPARING LEATHER

(75) Inventors: Anton Georges El A'mma, Phoenixville, PA (US); Shang-Jaw Chiou, Lower Gwynedd, PA (US); Robert Francis Dougherty, Hatboro, PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 10/372,567

(22) Filed: Feb. 21, 2003

(65) Prior Publication Data

US 2003/0180469 A1 Sep. 25, 2003

Related U.S. Application Data

(60) Provisional application No. 60/361,763, filed on Mar. 5, 2002.

(51) Int. Cl.
*C14C 9/02* (2006.01)
*C14C 3/00* (2006.01)

(52) U.S. Cl. ..... 8/94.33; 8/94.1 R; 8/94.21; 510/275; 427/389; 252/8.57; 525/183; 525/329.7

(58) Field of Classification Search ..... 8/94.1, 8/94.15, 94.19, 94.1 R, 94.33, 94.21; 524/512; 424/78.09; 523/122; 260/29.6; 510/275; 427/389; 252/8.57; 525/189, 329.7
See application file for complete search history.

(56) References Cited

U.S. PATENT DOCUMENTS

| | | | | |
|---|---|---|---|---|
| 3,269,858 A | | 8/1966 | Mattei | 117/142 |
| 3,269,859 A | | 8/1966 | Mattei et al. | 117/142 |
| 3,976,614 A | * | 8/1976 | Elms et al. | 524/512 |
| 4,105,615 A | * | 8/1978 | Balatan | 524/555 |
| 4,158,736 A | | 6/1979 | Lewis et al. | 560/205 |
| 4,314,800 A | | 2/1982 | Monsheimer et al. | |
| 5,124,181 A | | 6/1992 | Schaffer et al. | 427/323 |
| 5,316,860 A | * | 5/1994 | Stewart et al. | 428/473 |
| 5,324,879 A | | 6/1994 | Hawthorne | 585/511 |
| 5,348,807 A | | 9/1994 | Hodder et al. | 428/473 |
| 5,362,826 A | | 11/1994 | Berge et al. | 526/194 |
| 5,576,386 A | | 11/1996 | Kempter et al. | 526/88 |
| 5,709,714 A | * | 1/1998 | Natoli et al. | 8/94.21 |
| 5,710,227 A | | 1/1998 | Freeman et al. | 526/208 |
| 5,997,952 A | * | 12/1999 | Harris et al. | 427/302 |
| 6,610,282 B1 | * | 8/2003 | Ghosh | 424/78.09 |
| 2004/0221395 A1 | * | 11/2004 | Biver et al. | 8/94.15 |

FOREIGN PATENT DOCUMENTS

| | | |
|---|---|---|
| EP | 0 757 108 A2 | 2/1997 |
| EP | 0 757 108 B1 | 9/1999 |
| EP | 1 010 706 A2 | 6/2000 |
| GB | 885604 | 12/1961 |

* cited by examiner

*Primary Examiner*—Lorna M Douyon
*Assistant Examiner*—Tri V Nguyen
(74) *Attorney, Agent, or Firm*—Cantor Colburn LLP; Kim R. Jessum

(57) ABSTRACT

An oligomeric composition containing oligomers and at least one stabilizing component is provided. An aqueous dispersion composition containing the oligomeric composition is useful for treating tanned leather to provide leather with increased softness or strength. Also provided are a method of treating tanned leather using the composition and an article containing the treated leather.

11 Claims, No Drawings

COMPOSITION AND METHOD FOR PREPARING LEATHER

CROSS REFERENCE TO RELATED PATENT APPLICATIONS

This is a non-provisional application of prior pending U.S. provisional application Ser. No. 60/361,763 filed Mar. 5, 2002.

This invention relates to an oligomeric composition containing select oligomers and a stabilizing component, and to an aqueous dispersion composition containing the select oligomers and the stabilizing component. The aqueous dispersion composition is useful for treating leather, in particular, in the fatliquoring treatment step. Also provided are a method for improving the properties of tanned leather and an article containing the treated leather prepared by the method of this invention.

The processing of animal hides to produce leather involves a number of interdependent chemical and mechanical operations. Each of these operations has an effect on the final properties of the treated leather product. One important chemical operation in the treatment of leather is fatliquoring. Fatliquoring is used to impart the desired strength and temper properties to tanned leather. Fatliquors lubricate the leather fibers so that after the leather is dried its fibers are capable of sliding over one another. In addition to regulating the pliability of the leather, fatliquoring contributes greatly to the tensile and tearing strength of the leather. Fatliquoring also affects the tightness of the break or crease pattern formed when the grain surface is bent inward; the object being to produce a leather which leaves no or few fine wrinkles when bent.

The basic ingredients used in conventional fatliquoring operations are water insoluble oils and fatty substances such as raw oils and sulfated and sulfited oils. Typically the weight percent of fatliquor oil on weight of leather ranges from 3 to 20 percent. The manner in which the oil is distributed throughout the leather affects the character of the leather and subsequent finishing operations. In order to obtain an uniform oil coating over a large surface area of leather fibers it is typically necessary to dilute the oil with an organic solvent or preferably to disperse the oil in an aqueous system using emulsifiers.

U.S. Pat. No. 5,348,807 discloses an aqueous dispersion of an amphiphilic copolymer useful for fatliquoring leather. The amphiphilic copolymer is formed from greater than 10 percent by weight to less than 50 percent by weight of at least one hydrophilic monomer and greater than 50 percent by weight to less than 90 percent by weight of at least one hydrophobic comonomer. Hydrophilic monomers include carboxylic acid containing monomers. The reference discloses that the fatliquor containing the amphiphilic copolymer dispersion may be provided substantially solventless and may be employed to treat leather for automobile upholstery which is low fogging. Fogging refers to the condensation of evaporated volatile substances onto the glass windows, particularly the windshield, of an automobile. Despite this disclosure, fatliquors, which are substantially free of solvents, are desired for providing leather with increased softness. Further, to lower transportation costs, the fatliquor supplier desires high solids fatliquor compositions, in particular, compositions that can be supplied and shipped to the leather producer at or near 100 weight % solids, and emulsified prior to the fatliquoring process.

The inventors have discovered an aqueous dispersion for the fatliquor treatment of leather that provides the resulting leather with increased softness. The aqueous dispersion, which contains select oligomers, also provides the treated leather with a range of fullness and acceptable strength. Further, an oligomeric composition containing the select oligomers has been found that may be produced and shipped at high solids, and transformed into the aqueous dispersion by the leather producer, prior to the fatliquor treatment process.

The first aspect of this invention provides an oligomeric composition containing: oligomers containing from 90 to 100 weight % at least one first monomer and from zero to 10 weight % at least one ionic monomer, as polymerized units, based on weight of the oligomers; wherein the oligomers have a weight average molecular weight in the range of 500 to 100,000; and at least one stabilizing component.

The second aspect of the present invention provides a method for improving the properties of tanned leather, including the step of: contacting the tanned leather with an aqueous dispersion composition containing: at least one stabilizing component, and oligomers containing from 90 to 100 weight % at least one first monomer and from zero to 10 weight % at least one ionic monomer, as polymerized units, based on weight of the oligomers; wherein the oligomers have a weight average molecular weight in the range of 500 to 100,000.

In the third aspect of this invention, an article is provided having leather produced by a method, including the step of: contacting tanned leather with an aqueous dispersion composition comprising: at least one stabilizing component, and oligomers containing from 90 to 100 weight % at least one first monomer and from zero to 10 weight % at least one ionic monomer, as polymerized units, based on weight of the oligomers; wherein the oligomers have a weight average molecular weight in the range of 500 to 100,000.

As used herein, the term "(meth)acrylate" refers to either acrylate or methacrylate, the term "(meth)acrylic" refers to either acrylic or methacrylic.

"Glass transition temperature" or "$T_g$" as used herein, means the temperature at or above which a glassy polymer will undergo segmental motion of the polymer chain. Glass transition temperatures of a polymer can be estimated by the Fox equation [*Bulletin of the American Physical Society* 1, 3 Page 123 (1956)] as follows:

$$\frac{1}{T_g} = \frac{w_1}{T_{g(1)}} + \frac{w_2}{T_{g(2)}}$$

For a copolymer, $w_1$ and $w_2$ refer to the weight fraction of the two comonomers, and $T_{g(1)}$ and $T_{g(2)}$ refer to the glass transition temperatures of the two corresponding homopolymers in degrees Kelvin. For polymers containing three or more monomers, additional terms are added ($w_n/T_{g(n)}$). The $T_g$ of a polymer phase can also be calculated by using the appropriate values for the glass transition temperatures of homopolymers, which may be found, for example, in "Polymer Handbook", edited by J. Brandrup and E. H. Immergut, Interscience Publishers. The values of $T_g$ reported herein are measured using differential scanning calorimetry.

The oligomeric composition of the present invention contains oligomers. Oligomers are low molecular weight addition polymers formed by the polymerization of ethylenically unsaturated monomers. The weight average molecular weight of the oligomers is preferably in the range of 500 to 100,000, more preferably in the range of 1,000 to 50,000, and most preferably in the range of 1,500 to 25,000, as measured by gel permeation chromatography. The oligomers contain from 90 to 100 weight % of at least one first monomer and from zero to 10 weight % of at least one ionic monomer, as polymerized units. Preferred ranges for the at least one first monomer is 93 to 99.5 weight %, and more preferably in the range of 95 to 98 weight %. A preferred range for the ionic monomer is 0.5 to 7 weight %, and more preferably in the range of from 5 to 2 weight %. The oligomers may be homo-oligomers containing a single first monomer or may be co-oligomers containing at least two first monomers or at least one first monomer and at least one ionic monomer. As used herein, the composition ranges for co-oligomers refers to the average composition of the oligomers contained within the oligomeric composition of this invention. For example, the polymerization of a reaction mixture containing 98 weight % of a first monomer and 2 weight % of an ionic monomer, may result in one subgroup of oligomers containing both the first monomer and the ionic monomer as polymerized units, as well as a second subgroup of oligomers containing only first monomer as polymerized units. Mixtures of two or more different oligomers may be used. For example, the oligomeric composition may contain 50 weight % of first oligomers, which contain 100 weight % of the at least one first monomer as polymerized units, and 50 weight % of second oligomers, which contain 92 weight % of the at least one first monomer and 8 weight % of at least one ionic monomer as polymerized units. Further, the oligomers contained in the oligomeric composition of this invention may be fully saturated or may contain unsaturated bonds either within the oligomer chain or at one or both terminal positions of the oligomer chain.

First monomers suitable for preparing the oligomers include alkyl (meth)acrylates such as $C_1$ to $C_{40}$ alkyl (meth) acrylates such as methyl (meth)acrylate, ethyl (meth)acrylate, butyl (meth)acrylate, and ethylhexyl (meth)acrylate; hydroxyl containing (meth)acrylates such as hydroxyethyl (meth)acrylate and hydroxypropyl (meth)acrylate; styrene and substituted styrenes such as $\alpha$-methyl styrene; $\alpha$-olefins such as ethylene, propylene, and 1-hexene; chlorinated olefins such as vinyl chloride and vinylidene chloride; vinyl esters such as vinyl acetate and vinyl versatate; and acrylonitrile and methacrylonitrile. Preferred first monomers include butyl acrylate; 2-ethylhexyl acrylate; $C_{12}$ to $C_{24}$ alkyl (meth) acrylates such as lauryl (meth)acrylate, cetyl-eicosyl (meth) acrylate, and stearyl (meth)acrylate; and mixtures thereof.

Ionic monomers suitable for preparing the oligomers include monoethylenically unsaturated acidic, basic monomers, and salts thereof. Acidic monomers include carboxylic acid monomers such as (meth)acrylic acid, itaconic acid, fumaric acid, maleic acid, and anhydrides of such acids; strong acid monomers such as phosphoethyl (meth)acrylate and sulfoethyl (meth)acrylate; and acid substituted (meth) acrylamides such as, for example, 2-acrylamido-2-methylpropylsulfonic acid. Basic monomers include amine substituted (meth)acrylates such as dimethylaminoethyl (meth) acrylate, t-butyl-aminoethyl (meth)acrylate, and dimethylaminopropyl (meth)acrylamide; amide substituted monomers such as acrylamide and methacrylamide; and the like. Preferred ionic monomers used to prepare the oligomers include acrylic acid and methacrylic acid.

Specific combinations of the at least one first monomer and the optional at least one ionic monomer are chosen to undergo copolymerization to prepare the oligomers of the oligomeric composition, and to provide the desired application properties, as is known in the art. Preferably, the oligomers are prepared from at least one first monomer and optionally, one or more ionic monomers to provide an oligomers with a glass transition temperature of less than 20° C. Oligomers with low glass transition temperatures are useful for preparing leather having a softer feel.

The oligomers may be prepared by any polymerization process suitable for preparing low molecular weight polymers including bulk polymerization, solution polymerization, and emulsion polymerization. The polymerization process may be batch, semicontinuous, or bulk. Polymerization processes to prepare the oligomers include, for example, anionic polymerization as disclosed in U.S. Pat. No. 4,158,736; radical polymerization with chain transfer agents such as cobalt complexes as described in U.S. Pat. No. 5,324,879; polymerization in the presence of catalytic chain transfer agents as described in U.S. Pat. No. 5, 362,826; and continuous radical polymerization as described in U.S. Pat. No. 5,576,386.

In one embodiment of this invention, the oligomers are prepared by a continuous high temperature polymerization process as described in U.S. Pat. No. 5,710,227 or in EP 101076 A2. This process is suitable for preparing oligomers having the weight average molecular weight in the range of 500 to 20,000 and having narrow polydispersities. In this process, a reaction mixture is prepared containing from 90 to 100 weight % of at least one first monomer and from 0 to 10 weight % of at least one ionic monomer, based on the total weight of monomers in the reaction mixture. The reaction mixture may also contain from 0.1 to 25 weight % of at least one free-radical initiator, based on the total weight of monomers in the reaction mixture. Suitable initiators are any conventional free-radical initiators including, but not limited to, hydrogen peroxide, certain alkyl hydroperoxides, dialkyl peroxides, peresters, percarbonates, persulfates, peracids, oxygen, ketone peroxides, azo initiators, and combinations thereof. Specific examples of some suitable initiators include hydrogen peroxide, oxygen, tertiary-butyl hydroperoxide, di-tertiary butyl peroxide, tertiary-amyl hydroperoxide, di-tertiary-amyl peroxide, methylethyl ketone peroxide, and combinations thereof.

In the continuous high temperature polymerization process, the monomer may be polymerized as dilute solution, although the process of this embodiment does not require solvent, nor is the use of a solvent preferred. The reaction mixture may contain one or more solvents at a level of from zero to 99.5 weight %, preferably from 30 to 97 weight %, and most preferably from 50 to 95 weight %, based on the weight of the reaction mixture. Suitable solvents for the continuous high temperature polymerization process are capable of dissolving the at least one first monomer and the optional ionic monomer, especially under the supercritical fluid conditions of the process, and the oligomers formed therefrom. Suitable solvents for this process include, for example, ethers such as tetrahydrofuran; ketones such as acetone; esters such as ethyl acetate; alcohols such as methyl alcohol and butyl alcohol; alkanes such as hexane and heptane; mineral oil; vegetable oils such as castor oil; fatty acids such as oleic acid; aromatic hydrocarbons such as benzene, toluene, and xylene; supercritical fluids such as carbon dioxide; water; and mixtures thereof.

Next, the reaction mixture is continuously passed through a heated zone, wherein the reaction mixture is maintained at a temperature of at 150° C., preferably at a temperature in the range of from 180° C. to 450° C., and most preferably at a temperature in the range of from 220° C. to 325° C., at elevated pressure. Polymerization at the elevated temperatures of the continuous high temperature polymerization process is rapid. Thus, the reaction mixture may be maintained at the polymerization temperature for as little as 0.1 seconds up to 5 minutes, preferably from 0.5 seconds to 4 minutes, and most preferably from 1 second to 3 minutes. The elevated temperatures of the polymerization process require that the polymerization reactor be equipped to operate at an elevated pressure of at least 3 MPa to maintain the contents of the reactor as a fluid at the reaction temperature. In general, it is preferred to conduct the polymerization at from 7 MPa to 35 MPa, and more preferably at from 10 MPa to 30 MPa.

In the continuous high temperature polymerization process, the monomers, initiator, and optionally, solvent are combined to form a reaction mixture. The order of combining the components of the reaction mixture is not critical to this process. For example, it may be desirable to use one or more solvents, heat the one or more solvents to an elevated temperature, and add the monomers and the initiator to the heated solvent to form the reaction mixture. It is preferred to add the initiator last. The reaction mixture may be formed at a temperature below, at, or above the polymerization temperature. Additional solvent may be added to the oligomer product while the oligomer product is at an elevated temperature to maintain fluidity of the oligomer product.

The continuous high temperature polymerization process may be conducted in tubular reactors having no moving parts and of any cross-sectional shape that permits continuous, steady state flow, and that may operate under the elevated temperatures and pressures. Such reactors are typically made from inert materials, such as stainless steel or titanium. The reactor may be of any length and cross-sectional dimension that permits effective temperature and pressure control.

In one embodiment, the oligomers are prepared by continuous high temperature polymerization of a reaction mixture containing from 0.5 to 10 weight % α-methyl styrene based on total weight of monomers in the reaction mixture.

Residual monomers or solvents in the oligomer product may be may be removed by any of several techniques known to those skilled in the art, including rotary evaporation, distillation such as wiped film distillation, and vacuum distillation.

The oligomeric composition of this invention also contains at least stabilizing component such as a surfactant. Suitable surfactants include anionic surfactants, nonionic surfactants such as cationic surfactants, amphoteric surfactants, or mixtures thereof.

Suitable anionic surfactants include, for example, the higher fatty alcohol sulfates, such as sodium lauryl sulfate; alkylaryl sulfonates such as sodium or potassium isopropylbenzene sulfonates or isopropyl naphthalene sulfonates; alkali metal higher alkyl sulfosuccinates, such as sodium octyl sulfosuccinate, sodium N-methyl-N-palmitoylaurate, sodium oleyl isothionate; alkali metal salts and ammonium salts of fatty acids such as salts of oleic acid; alkali metal salts and ammonium salts of sulfates or sulfonates of oils and fatty acids; alkali metal salts and ammonium salts of alkylaryl polyethoxyethanol sulfates, sulfonates, or phosphates, such as sodium tert-octylphenoxypolyethoxyethyl sulfate having 1 to 50 oxyethylene units; alkali metal salts and ammonium salts of alkyl polyethoxyethanol sulfates, sulfonates, and phosphates; and alkali metal salts and ammonium salts of aryl polyethoxyethanol sulfates, sulfonates, and phosphates.

Suitable nonionic surfactants include but are not limited to polyesters, for example, ethylene oxide and propylene oxide condensates which include straight and/or branched chain alkyl and alkaryl polyethylene glycol and polypropylene glycol ethers and thioethers; alkylphenoxy poly(ethyleneoxy) ethanols having alkyl groups containing from 7 to 10 carbon atoms and having from 4 to 240 ethyleneoxy units, such as heptyl-phenoxy poly(ethyleneoxy) ethanols, nonyl-phenoxy poly(ethyleneoxy)ethanols, and so forth; the polyoxyalkylene derivatives of hexitol, including sorbitans, sorbides, mannitans, and mannides; partial long chain fatty-acid esters, such as the polyoxyalkylene derivatives of sorbitan monolaurate, sorbitan monopalmitate, sorbitan monostearate, sorbitan tristearate, sorbitan monooleate, and sorbitan trioleate; the condensates of ethylene oxide with a hydrophobic base, such as a base that is formed by condensing propylene oxide with propylene glycol; sulfur-containing condensates, for example, those prepared by condensing ethylene oxide with higher alkyl mercaptans, such as nonyl, dodecyl, or tetradecyl mercaptan, or with alkyl thiophenols wherein the alkyl group contains from 6 to 15 carbon atoms; ethylene oxide derivatives of long-chain carboxylic acid, such as lauric, myristic, palmitic, or oleic acids or mixtures of acids, such as tall oil fatty acids; ethylene oxide derivatives of long chain alcohols such as octyl, decyl, lauryl, or cetyl alcohols; and combinations thereof.

Suitable cationic surfactants include quaternary surfactants such as alkyl benzyl dimethylammonium salts, alkyl betaines, tetraalkylammonium salts, and heterocyclic ammonium salts; alkyl amines; and alkyl imidazolines.

Suitable amphoteric surfactants include alkylamido alkyl amines such as sarcosine and lauroamphodipropionic acid; and alkyl substituted amino acid such as myristaminopropionic acid and N-coco-β-aminoproprionic acid.

In one embodiment, the stabilizing component is one or more surfactants that are combined with the oligomers to form the oligomeric composition. In this embodiment, the oligomeric composition can be dispersed into an aqueous medium to provide the oligomers as an aqueous dispersion of oligomer particles. The level of surfactant in the oligomeric composition aids in the emulsification of the oligomers into an aqueous medium or in providing the resulting dispersion with sufficient stability to be applied onto a substrate. The oligomeric composition may contain a level of surfactant in the range of 1 to 50 weight %, preferably in the range of 4 to 40 weight %, and more preferably in the range of 6 to 25 weight %, based on the weight of oligomers in the oligomeric composition.

In one embodiment, the oligomeric composition contains from 65 to 99 weight % of one or more oligomers and from 1 to 35 weight % of at least one surfactant, based on the total weight of the oligomers and the at least one stabilizing component. In this embodiment, the oligomeric composition is substantially free of water or solvents, wherein the oligomeric composition preferably contains less than 5 weight %, more preferably less than 2 weight %, and most preferably less than 0.5 weight % water or solvent, based on the weight of the oligomeric composition. The oligomeric composition of this embodiment is suitable as a pre-dispersion composition for treating leather. The pre-dispersion composition has higher solids compared to an aqueous dispersion, thus it can be shipped to the leather producer or another end user at lower shipping costs, on an active solids basis. The addition of the pre-dispersion composition to an aqueous medium by the leather producer or another end user provides an aqueous dispersion composition containing the oligomers, suitable as a fatliquor for the treatment of leather. The pre-dispersion composition may optionally contain adjuvants such as biocides, humectants, mildewcides, antioxidants, silicone oils, and wetting agents.

Various techniques may be employed to disperse the oligomeric composition containing the oligomers and the surfactant into an aqueous medium to provide an aqueous dispersion composition. Suitable techniques include mixing with mechanical stirrers, shaking, and using a homogenizer. The oligomeric composition and the aqueous medium may be combined in any order. Preferably the oligomeric composition is added to an aqueous medium having a temperature in the range of 50° C. to 75° C. The addition of base to the aqueous medium may aid in the dispersion of the oligomeric composition containing an anionic surfactant. The addition of acid to the aqueous medium may aid in the dispersion of the oligomeric composition containing a cationic surfactant. The oligomeric composition may also be heated prior to addition.

The aqueous medium of the aqueous dispersion composition of this invention contains water and optionally solvents such as alcohols; glycols such as ethylene glycol; diols such as 1,3-propane diol; ketones such as acetone; and coalescents such as glycol ethyl ethers and propylene glycol ethers. Preferably the aqueous medium is substantially free of solvent such that the aqueous medium contains less than 5 weight % solvent, more preferably less than 3 weight % solvent, and most preferably less than 1 weight % solvent, based on the weight of the aqueous dispersion composition. A suitable range of solvent in the aqueous medium is from zero to less than 5 weight %, zero to less than 3 weight %, and more preferably from zero to less than 1 weight %, based on the weight of the aqueous dispersion composition. The pH of the aqueous medium may be adjusted by the addition of one or more acids, or one or more bases. Suitable acids include acetic acid and formic acid. Suitable bases include ammonia, hard bases such as sodium hydroxide and potassium hydroxide; and organic bases such as ethanol amine, diethanol amine, and triethanol amine. A pH range of 4 to 9 is preferred for the aqueous dispersion composition containing an anionic surfactant. A pH range of 2 to 7 is preferred for the aqueous dispersion composition containing a cationic surfactant. A pH range of 2-9 is preferred for the aqueous dispersion composition containing either a nonionic surfactant or an amphoteric surfactant. Suitable average particle diameters for the oligomer particles contained in the aqueous dispersion composition are in the range of 30 nanometers (nm) to 10 microns, preferably in the range of from 30 nm to 2 microns, and more preferably in the range of 30 nm to 700 nm. The average particle diameter may be measured by a quasi-elastic light scattering technique, using an instrument such as a Brookhaven Model BI-90 Particle Sizer, supplied by Brookhaven Instruments Corporation, Holtsville, N.Y. Smaller diameter particles may provide more facile penetration of the tanned leather.

The oligomers may also be provided as the aqueous dispersion composition by adding the oligomers to an aqueous medium containing a stabilizing component. In the presence of a stabilizing component, the oligomers may be dispersed into the aqueous medium and stabilized as insoluble particles containing the oligomers. Suitable stabilizing components include surfactants and amphiphilic copolymers. One or more stabilizing components may be used to prepare the oligomers as the aqueous dispersion composition. Suitable surfactants include the aforementioned surfactants that may be employed to prepare the oligomeric composition. Amphiphilic copolymers are water dispersible polymers containing at least 50 weight % of hydrophobic monomer and less than 50 weight % of hydrophilic monomer, as polymerized units. The hydrophobic monomer may be selected from long chain alkyl(meth)acrylates, long chain alkoxy(polyethyleneoxide) (meth)acrylates, primary alkenes, and vinyl esters of long chain alkyl carboxylic acids, and mixtures thereof. Examples of hydrophobic monomers include $C_4$ to $C_{40}$ alkyl (meth)acrylates such as dodecyl (meth)acrylate, lauryl (meth)acrylate, stearyl (meth)acrylate, and cetyl (meth)acrylate; $C_4$ to $C_{22}$ alkoxy or $C_1$ to $C_{12}$ alkyl phenoxy (polyethylene oxide) (meth)acrylates such as nonylphenoxy (ethyleneoxide)$_{1-20}$ (meth)acrylate; $C_8$ to $C_{22}$ 1-alkenes such as 1-octadecene, 1-hexadecene, 1-tetradecene, and 1-dodecene; and vinyl esters of $C_8$ to $C_{22}$ alkyl carboxylic acids such as vinyl laurate and vinyl stearate. The hydrophilic monomer may be selected from acidic and basic monomers including carboxylic acids, strong acid monomers, and amine substituted (meth)acrylates.

The oligomers may be dispersed into the dispersion containing the amphiphilic copolymer adjusting the pH of the amphiphilic copolymer dispersion to a value in the range of 4 to 8 and adding the oligomers with mixing. The amphiphilic copolymer dispersion may be heated prior to the addition of the oligomers. The ratio of oligomers to amphiphilic copolymer in the oligomeric composition may be in the range of 1:10 to 10:1, on a weight basis.

In one embodiment, the aqueous dispersion composition of this invention is prepared by aqueous emulsion polymerization. In this process, the oligomers are prepared as dispersed particles in an aqueous medium. Aqueous emulsion polymerization includes preparing a monomer mixture containing at least one first monomer and optional ionic monomer, and polymerizing the monomer mixture in an aqueous medium. The aqueous emulsion polymerization process may be a redox or thermal initiation process employing conventional free radical initiators, such as, for example, ammonium and sodium persulfates, hydrogen peroxide, benzoyl peroxide, or t-butyl peroctoate at levels typically of from 0.05 to 3% by weight based on the total weight of monomer. Redox systems using the same initiators coupled with suitable reducing agents such as for example isoascorbic acid, sodium bisulphite, or sodium sulphoxylate formaldehyde may be used at similar levels. A stabilizing component such as surfactant or a dispersing agent is included in the polymerization process to emulsify the monomer mixture, or to provide control of the oligomer particle size, or to provide stability to the resulting dispersed oligomer particles. Suitable stabilizing components include surfactants such as nonionic and anionic surfactants, polymeric dispersing agents such as hydroxyethyl cellulose, methyl cellulose, polyacrylic acid, polyvinyl alcohol, and amphiphilic copolymer dispersions. Examples of suitable anionic surfactants include alkali fatty alcohol sulfates, alkali arylalkyl sulfonates, alkali alkyl sulfosuccinates, and alkali arylalkylpolyethoxyethanol sulfates or sulfonates. Examples of nonionic surfactants and dispersing agents include alkyl phenoxypolyethoxy ethanols, having alkyl groups of from 7 to 18 carbon atoms and from 6 to 60 oxyethylene units, ethylene oxide esters of long chain carboxylic acids or mixtures of these acids; ethylene oxide condensates of long-chain or branched chain amines; and block copolymers of ethylene oxide sections combined with one or propylene oxide sections.

Chain transfer agents such as mercaptan, polymercaptan, and polyhalogen compounds in the polymerization mixture may be used to moderate the molecular weight of the polymerization to provide oligomers with the desired molecular weight. Examples of chain transfer agents which may be used include long chain alkyl mercaptans such as t-amyl mercaptan and t-dodecyl mercaptan; butyl mercaptoproprionate; alcohols such as isopropanol, isobutanol, lauryl alcohol, or t-octyl alcohol; and chlorinated compounds such as carbon tetrachloride, tetrachloroethylene, trichlorobromoethane. Generally from 0.1 to 10 weight %, based on the weight of total monomer in the oligomer, may be used. Alternatively, suitable molecular weights may be obtained by increasing the initiator level, or by a combination of increased initiator level and a chain transfer agent.

The aqueous dispersion composition may optionally contain other ingredients such as retanning agents, vegetable extracts, coloring agents such as dyes and pigments, other fatliquors, rheology modifiers, biocides, mildewcides, wetting agents, coalescents, rheology modifiers, fluorocarbons; plasticizers, silicone oils, and fillers such as clay and proteins.

Tanned leather is an animal hide or a skin that has been treated to convert the hide or skin to a stable non-spoilable material. The principle method used to tan hides and skins is known as "chrome tanning". This process employs a basic chromium sulfate, often referred to as "chrome" as the tanning agent. Other suitable tanning agents include salts of aluminum, zirconium, titanium, iron, and magnesium; and vegetable extracts such as extracts from trees and shrubs such as quebracho, wattle, sumac, hemlock, oak, and spruce. The tanned leather may be prepared from the cattle hides, pigskin, or sheepskin.

The fatliquoring process includes contacting tanned leather with the fatliquoring composition containing the aqueous dispersion composition of this invention and maintaining this contact until a sufficient amount of the oligomers has deposited onto the tanned leather or penetrated into the tanned leather. The fatliquoring composition may contain from 1 to 80 weight % of the oligomers, based on the weight of the fatliquoring composition. Other materials may be added to the fatliquoring composition such as acids or bases, wetting agents, additional surfactants, fluorocarbons, penetrating agents, glycol ethers, and silicone oils. The duration of the fatliquoring step involving the exposure of the tanned leather to the aqueous dispersion depends upon many factors including the type of tanned leather, the prior treatment of the tanned leather, the concentration of the oligomers in the fatliquoring composition, and the temperature of the fatliquoring composition. Typical fatliquoring times may vary from 30 minutes to 2 hours. After the fatliquoring step, the treated leather is dried or allowed to dry, and may then be processed by a sequence of steps such as conditioning, staking, buffing, finishing, plating, measuring, and grading. A description of each of these operations is provided in *Practical Leather Technology*, $4^{th}$ Edition, Thomas C. Thorstensen, Krieger Publishing Company (1993). The leather treated with the aqueous dispersion composition of this invention may contain from 2 to 10 weight % oligomers, based on the weight of the leather.

The fatliquoring composition may additionally contain dye or pigment to color the tanned leather, thus allowing the combination of the coloring and the fatliquoring steps into a single process.

The fatliquoring composition may additionally contain a retanning agent, thus allowing the combination of the retanning and the fatliquoring steps into a single process. The amphiphilic copolymer dispersion is a suitable retanning agent.

The leather produced by the process of this invention may be used in automotive upholstery, garments, shoes, furniture, and gloves. The combination of required properties including the softness, the fullness, and the strength of the leather varies with the intended enduse. Generally, softer leather is desired for furniture, garments, and gloves.

The following examples are presented to illustrate the invention and the results obtained by the test procedures. The examples are illustrative only and are not intended, nor should they be construed, to limit the scope of the invention as modifications should be obvious to those of ordinary skill in the art.

| Abbreviations | |
|---|---|
| AA | acrylic acid |
| AMS | α-methyl styrene |
| BA | butyl acrylate |
| CEMA | cetyl-eicosyl methacrylate |
| EHA | 2-ethylhexyl acrylate |
| DPM | dipropyleneglycol methyl ether |

EXAMPLE 1

Preparation of the Oligomers Using a High Temperature Polymerization Process The Equipment and General Procedure: The continuous high temperature polymerization reactor was a section of stainless steel tubing, 11.9 meter in length and having an inner diameter of 3.2 millimeters ($1/8^{th}$ inch), that was connected at one end to a high pressure pump (Thermoseparation Model ConstraMetric 3200) and at the other end to a back-pressure control device. Between the two ends, the section of tubing was coiled and situated inside an oven. The oven was equipped with a temperature probe, which was connected to a temperature controlling device. The temperature controlling device regulated the heat imparted to the coiled tubing. A heat exchanger was equipped to remove the heat before the sample was collected.

A reaction mixture was prepared by mixing monomers, initiator, and optionally, solvent. The reaction mixture contained 86 weight % first monomer and optional ionic monomer in 14 weight % acetone, based on the total weight of the monomers and acetone, and 2.0 weight % based on the weight of monomers of di-tert-amyl peroxide. Acetone was pumped through the reactor at a flow rate to provide a residence time of 4 minutes. The reactor pressure was maintained at a level of from 3.45 to 13.8 MPa (500 to 2000 pounds per square inch). The oven was heated to the desired polymerization temperature (180-250° C.). After about 15 minutes, the acetone being pumped through the reactor was replaced by the reaction mixture which was continuously pumped through the reactor at a constant rate. After allowing a suitable amount of time for the acetone to be cleared from the reactor, product was collected as the effluent from the back-pressure control device. When the addition of the reaction mixture was nearly complete, acetone was pumped through the tubing at the same rate and temperature as the reaction mixture. The oligomers was isolated using either the distillation apparatus or wipe-film-evaporator to remove volatile materials.

The oligomers of Examples 1.1-1.8 were prepared according to the general procedure outline above using the reaction mixtures listed in Table 1.1. The weight average molecular weight, Mw, of each of the oligomers was measured by gel permeation chromatography using polystyrene as the standard. The compositions and molecular weights of the oligomers prepared by continuous high temperature polymerization are shown in Table 1.1.

TABLE 1.1

Reaction Mixture Compositions and Molecular Weights of the Oligomers Prepared by the High Temperature Polymerization Process

| Oligomers | BA (wt. %) | AMS (wt. %) | AA (wt. %) | Solvent | Mw |
|---|---|---|---|---|---|
| Example 1.1 | 95 | 5 | 0 | acetone | 2970 |
| Example 1.2 | 97 | 3 | 0 | acetone | 3403 |
| Example 1.3 | 95 | 3 | 2 | acetone | 3140 |
| Example 1.4 | 95 | 3 | 2 | acetone | 3138 |
| Example 1.5 | 92 | 3 | 5 | acetone | 3392 |
| Example 1.6 | 95 | 3 | 2 | oleic acid | 3720 |
| Example 1.7 | 95 | 3 | 2 | — | 3689 |
| Example 1.8 | 97 | 3 | 0 | DPM | 3422 |

Surfactant was added to the oligomers of Example 1.4 to prepare the oligomeric composition of this invention. Next, oligomeric composition was added with mixing to an aqueous solution containing sodium hydroxide at a temperature in the range of 50° C. to 70° C. to provide the aqueous dispersion composition containing the oligomers as dispersed particles. The average particle diameters of the aqueous dispersion composition were determined using a Brookhaven Instruments BI-90 Particle Sizer.

TABLE 1.2

Compositions and Properties of the Aqueous Dispersion Compositions Containing the Oligomers of Example 1.4

| | Example 1.4a | Example 1.4b | Example 1.4c | Example 1.4d | Example 1.4e |
|---|---|---|---|---|---|
| Oligomers of Example 1.4 | 60 g | 60 g | 60 g | 200 g | 140 g |
| Surfactant | 3 g Rhodafac ™ RS-610 | 6 g Rhodafac ™ RS-610 | 12 g Rhodafac ™ RS-610 | 40 g oleic acid | 28 g oleic acid |
| Aqueous Solution | 0.4 g NaOH in 50.4 g water | 0.8 g NaOH in 53.8 g water | 1.5 g NaOH in 59.5 g water | 5.5 g NaOH in 185.5 g water | 4 g NaOH in 144 g water |
| Average Particle Diameter | 1121 nm | 730 nm | 547 nm | 231 nm | 867 nm |
| Viscosity | 1030 cps | 320 cps | 600 cps | — | — |
| pH | 7.4 | 7.4 | 7.6 | — | — |
| Total Solids | 55.2 wt. % | 54.5 wt. % | 54.1 wt. % | 54.3 wt. % | 53.7 wt. % |

Rhodafac is a trademark of Rhone-Poulenc Chimie Corp., France. (100% active).

Aqueous dispersion compositions were prepared containing the oligomers and an amphiphilic copolymer dispersion as the stabilizing component. The amphiphilic copolymer dispersion was heated at 60° C. for a hour and sodium hydroxide was added prior to the addition of the oligomers. Amphiphilic Copolymer Dispersion A had an average composition of 70 CEMA and 30 AA by weight and a weight average molecular weight of 8,500, as described in European Patent Application 0757108A. Amphiphilic Copolymer Dispersion B had an average composition of 80 BA and 20 AA by weight and a weight average molecular weight of 10,600, as described in U.S. Pat. No. 5,348,807.

TABLE 1.3

Composition and Properties of the Aqueous Dispersion Compositions Containing Oligomers and Amphiphilic Copolymer Dispersion

| Aqueous Dispersion Composition | Oligomers | Amphiphilic Copolymer Dispersion | Oligomer/ Amphiphilic Copolymer Dispersion (Solids/Solids) | Solids (wt. %) |
|---|---|---|---|---|
| Example 1.1a | Example 1.1 | A (70CEMA/30AA) | 10/7 | 42.5 |
| Example 1.1b | Example 1.1 | A (70CEMA/30AA) | 20/7 | 54 |
| Example 1.2a | Example 1.2 | A (70CEMA/30AA) | 10/7 | 42 |
| Example 1.3a | Example 1.3 | A (70CEMA/30AA) | 10/7 | 42 |
| Example 1.2b | Example 1.2 | B (80BA/20AA) | 10/7 | 56.7 |
| Example 1.3b | Example 1.3 | B (80BA/20AA) | 10/7 | 56.7 |

The oligomeric composition of Example 1.6 was dispersed in an aqueous medium containing sodium hydroxide at 50 weight % solids, to provide the aqueous dispersion composition, Example 1.6a.

EXAMPLE 2

Preparation of the Oligomers by Solution Polymerization

A solution polymerization process was used to prepare the oligomers. A 2-liter, 4 necked round bottom flask equipped with a mechanical stirrer, a thermocouple, a condenser, and a nitrogen sparge was charged with 193.5 g of butoxyethanol.

Next, 96.6 g of a monomer mixture containing 617.4 EHA, 12.6 g AA, and 12.6 g 3-mercaptopropionic acid and 1 g t-butyl peroctoate in butoxyethanol was added to the flask. The contents of the flask were heated to 99° C. The remaining monomer mixture and an initiator solution containing 5.65 g t-butyl peroctoate in 27.4 g butoxyethanol were cofed to the flask over a period of 3 hours while the contents of the flask were maintained at a temperature of 101-102° C. After complete addition of the monomer mixture, the level of unreacted monomer was reduced by chasing with t-butyl peroctoate in butoxyethanol. Next, the contents of the flask were allowed to cool to 71° C. and 6.1 g of hydrogen peroxide (30% active) was added. The resulting solution contained the oligomers of this invention, Example 2.1, at a solids level of 63.1 weight %. The oligomers of Example 2.1 had a weight average molecular weight of 3,150.

The oligomeric composition of this invention was prepared by combining the oligomers of Example 2.1 with Amphiphilic Copolymer Dispersion C, as the stabilizing component. Amphiphilic Copolymer Dispersion C had a composition of 80 EHA and 20 AA, by weight and a weight average molecular weight of 21,300, as disclosed in U.S. Pat. No. 5,348,807. The oligomeric composition, Example 2.1a, contained 70 weight % oligomers (solids) and 30 weight % Amphiphilic Copolymer Dispersion C (solids), based on the total weight solids of the oligomeric composition.

EXAMPLE 3

Preparation of Leather

The tanned leather was prepared using chrome tanned cowhides as the tanned leather stock. All weights are based on the weight of the wet bluestock (chrome tanned stock). A weight of 100% means a weight equal to the weight of the stock in the drum.

1) The bluestock was given a water wash with the door of the rotating tanning drum partly open for 5 minutes at 35° C.

2) The drum was drained.

3) The bluestock and an added 100% float (float refers to water, 100% float means the addition of a weight of water equal to the stock weight) was neutralized with 2 weight % sodium acetate and 1.5-1.75 weight % sodium bicarbonate. The mixture was then drummed (mixed) for 3 hours. The pH of the neutralization float was monitored and maintained in the range of 6-6.5 by offering sodium bicarbonate to the leather in 0.5 weight % and 0.25 weight % portions as needed.

4) The drum was drained and its temperature raised to 40° C.

5) The neutralized bluestock was given a water wash with the door of the rotating drum partly open for 5 minutes at 40° C.

6) The neutralized bluestock was then offered 6% solids of a commercial fatliquor or the aqueous dispersion composition of this invention as the fatliquoring material. The fatliquoring material was first pre-dispersed in an appropriate vessel in a 50% float at 50° C. The fatliquor dispersion was then added to the tanning drum and the door of the tanning drum closed shut. The contents of the tanning drum were tumbled for 60 to 75 minutes.

7) Formic acid was added to the contents of the tanning drum at a level of 0.5 weight % formic acid (90% active), based on the weight of the bluestock. The formic acid was added as a 10 weight % solution in water. Drumming was continued for 30 minutes to lower the float pH to less than 4.

8) The clear float was drained from the drum.

9) The treated stock was water washed with the door of the tanning drum partly open for 5 minutes at 40° C.

10) The treated stock was horsed (piled on a wooden horse) overnight. The following day, it was set out to dry on a commercial set out machine to squeeze out excess water from the treated stock. The treated stock was next dried under vacuum at 46° C. for 100 seconds on a commercial vacuum drier.

11) The treated stock was then set out and hung to dry overnight on a vertical perforated frame.

12) The moisture content of the frame-dried treated stock (called crust) was adjusted to 16-19% by spraying it uniformly with water (called conditioning).

13) The resulting conditioned leather was then mechanically softened to provide the leather samples for testing.

Test Methods

Softness: The softness of the leather sample was determined by temper measurements. Temper is a measure of the flexibility and elasticity of leather. A higher temper value indicated that the leather sample had a softer feel, was more flexibility, and had increase elasticity than a leather sample with a lower temper value. Readings were made using a BLC ST300 Softness Tester (BLC, Northampton, United Kingdom). A temper value of 2 or greater indicated an acceptable level of softness. Higher temper values are desired in certain leather applications such as furniture, automobile upholstery, and garments.

Fullness: The fullness of the leather sample was determined by measuring the thickness of the leather sample. A higher value for the thickness indicated that the leather sample was full bodied and was not considered flat and empty. Thickness readings were made using a thickness gauge made by Federal Products Corp., Providence, R.I. and reported in millimeters (mm).

Strength. The strength of the treated leather was measured by a technique called elongation at ball burst. This technique is commonly used in the art to evaluate the effectiveness of fatliquors to lubricate and strengthen the leather. The test is designed to reproduce the stretching of leather over a last during shoemaking, using an instrument called the Lastometer. A strip of the leather sample was clamped in place and a probe then stretched the leather sample. The force of the probe was measured at the point where the leather sample was torn ("ball burst"). The greater the force required to tear the leather sample, the greater the strength of the leather. A strength value of greater than 9,730 kilograms/meter (kg/m) was considered acceptable.

Comparative A was the Amphiphilic Copolymer Dispersion A, a conventional fatliquoring composition.

TABLE 3.1

Evaluation of Leather Samples Treated with Examples 1.2a and 1.3a

| Fatliquoring Composition | Softness | Fullness (mm) | Strength (kg/m) |
|---|---|---|---|
| Example 1.2a | 3.7 | 1.8 | 17,090 |
| Example 1.3a | 4.1 | 1.9 | 12,950 |
| Comparative A | 2.8 | 2.0 | 17,680 |

The results in Table 3.1 showed that the fatliquoring treatment of tanned leather using the aqueous dispersion compositions of the this invention, as exemplified by Examples 1.2a and 1.3a, show that the resulting leather has increased softness compared to the comparative fatliquoring composition, Comparative A. The aqueous dispersion compositions also provided the leather samples with acceptable levels of fullness and strength.

Comparative B was Amphiphilic Copolymer Dispersion B, a conventional fatliquoring composition.

TABLE 3.2

Evaluation of Leather Sample Treated with Examples 1.2b and 1.3b

| Fatliquoring Composition | Softness | Fullness (mm) | Strength (kg/m) |
|---|---|---|---|
| Example 1.2b | 2.8 | 1.7 | 24,180 |
| Example 1.3b | 3.8 | 1.6 | 16,590 |
| Comparative B | 3.3 | 2.0 | 19,770 |

The results in Table 3.2 showed that the fatliquoring treatment of tanned leather using the aqueous dispersion composition of the this invention, as exemplified by Example 1.3b, had increased softness compared to the comparative fatliquoring composition, Comparative A, and an acceptable strength level. The leather prepared with Example 1.2b had higher strength than the leather prepared with Comparative B, while providing acceptable softness.

Comparative C was Amphiphilic Copolymer Dispersion C, a conventional fatliquoring composition.

TABLE 3.3

Evaluation of Leather Sample Treated with Examples 2.1a

| Fatliquoring Composition | Softness | Fullness (mm) | Strength (kg/m) |
|---|---|---|---|
| Example 2.1a | 2.8 | 1.6 | 18,050 |
| Comparative C | 3.4 | 1.7 | 9,770 |

The results in Table 3.3 show that the fatliquoring treatment of tanned leather using the aqueous dispersion composition of the this invention, as exemplified by Examples 2.1a, showed that the resulting leather has acceptable softness and strength.

TABLE 3.4

Evaluation of Leather Sample Treated with Examples 1.2b and 1.3b

| Fatliquoring Composition | Softness | Fullness (mm) | Strength (kg/m) |
|---|---|---|---|
| Example 1.1a | 4.3 | 1.8 | 14,590 |
| Example 1.1b | 4.9 | 1.7 | 18,270 |
| Example 1.6a | 2.2 | 1.5 | 11,590 |

The results in Table 3.4 show that the fatliquoring treatment of tanned leather using the aqueous dispersion compositions of the this invention, as exemplified by Examples 1.1a and 1.1b, showed that the resulting leather has increased softness while providing sufficient strength. The leather prepared with the aqueous dispersion composition of Example 1.6a had acceptable levels of softness and strength.

We claim:

1. An oligomeric composition comprising:

i) oligomers comprising from 90 to 100 weight % of at least one $C_1$ to $C_{40}$ alkyl (meth)acrylate first monomer and from zero to 10 weight % of at least one ionic monomer, as polymerized units, based on a weight of said oligomers, wherein said oligomers have a weight average molecular weight in the range of 1,500 to 25,000;

ii) from 4 to 50 weight %, based on said weight of said oligomers, of at least one amphiphilic copolymer formed from a hydrophobic monomer selected from the group consisting of $C_4$ to $C_{40}$ alkyl (meth)acrylates, $C_4$ to $C_{22}$ alkoxy or $C_1$ to $C_{12}$ alkyl phenoxy(polyethylene oxide) (meth)acrylates, $C_1$ to $C_{18}$ 1-alkenes, vinyl esters of $C_8$ to $C_{22}$ alkyl carboxylic acids, and combinations of one or more of the foregoing hydrophobic monomers, and a hydrophilic monomer selected from the group consisting of carboxylic acid, strong acid, and amine substituted (meth)acrylates; and 0.5 to 10 weight % α-methyl styrene based on the total weight of said monomers.

2. The oligomeric composition of claim 1 wherein said oligomers and said at least one amphiphilic copolymer are dispersed in an aqueous medium.

3. The oligomeric composition of claim 2 further comprising at least one base or at least one acid for adjusting a pH of the oligomeric composition.

4. The oligomeric composition of claim 2, wherein the composition has a pH of from 4 to 8.

5. The oligomeric composition of claim 1 wherein said oligomeric composition comprises from 65 to 99 weight % of said oligomers and from 6 to 35 weight % of said at least one amphiphilic copolymer, based on a total weight of said oligomers and said at least one surfactant.

6. The oligomeric composition of claim 1 further comprising a chain transfer agent.

7. The oligomeric composition of claim 1, wherein the least one first monomer is selected from the group consisting of butyl acrylate, 2-ethylhexyl acrylate, and $C_{12}$ to $C_{24}$ alkyl (meth)acrylates.

8. The oligomeric composition of claim 1, wherein the at least one amphiphilic copolymer comprises at least 50 weight % of hydrophobic monomer and greater than or equal to 20 weight % to less than 50 weight % of hydrophilic monomer, as polymerized units.

9. The oligomeric composition of claim 1, wherein the oligomeric composition, when applied to tanned leather, imparts to the tanned leather a temper of at least 2.8, a fullness of at least 1.6 mm, and a strength of at least 11,590 kg/m.

10. A method for improving the properties of tanned leather, comprising the step of:

contacting said tanned leather with an aqueous dispersion composition comprising:

i) oligomers comprising from 90 to 100 weight % of at least one $C_1$ to $C_{40}$ alkyl (meth)acrylate first monomer and from zero to 10 weight % of at least one ionic monomer, as polymerized units, based on weight of said oligomers, wherein said oligomers have a weight average molecular weight in the range of 1,500 to 25,000;

ii) from 4 to 50 weight %, based on said weight of said oligomers, of at least one amphiphilic copolymer comprising a hydrophobic monomer selected from the group consisting of $C_4$ to $C_{40}$ alkyl (meth)acrylates, $C_4$ to $C_{22}$ alkoxy or $C_1$ to $C_{22}$ alkyl phenoxy(polyethylene oxide) (meth)acrylates, $C_1$ to $C_{18}$ 1-alkenes, vinyl esters of $C_8$ to $C_{22}$ alkyl carboxylic acids, and combinations of one or more of the foregoing hydrophobic monomers and a hydrophilic monomer selected from the group consisting of carboxylic acid, strong acid, and amine substituted (meth)acrylates; and 0.5 to 10 weight % α-methyl styrene based on the total weight of said monomers.

11. The method of claim 10 wherein said aqueous dispersion composition comprises from 65 to 99 weight % of said oligomers and from 4 to 35 weight % of said at least one amphiphilic copolymer, based on a total weight of said oligomers and said at least one surfactant.

* * * * *